US005353731A

United States Patent [19]

Richter

[11] Patent Number: 5,353,731

[45] Date of Patent: Oct. 11, 1994

[54] MARINE ANCHOR

[76] Inventor: Rayohl E. Richter, 2727 S. 15th St., Sheboygan, Wis. 53081

[21] Appl. No.: 233,237

[22] Filed: Apr. 26, 1994

[51] Int. Cl.[5] ..... B63B 21/46

[52] U.S. Cl. ..... 114/299; 114/301

[58] Field of Search ..... 114/294, 297, 299, 300, 114/301; D12/215

[56] References Cited

U.S. PATENT DOCUMENTS

| | | | |
|---|---|---|---|
| D. 118,869 | 2/1940 | Tower . | |
| 2,365,136 | 12/1944 | Behrens | 114/206 |
| 2,424,040 | 7/1947 | Long | 114/207 |
| 2,722,191 | 11/1955 | Johnson | 114/208 |
| 2,956,529 | 10/1960 | Samalion | 114/208 |
| 3,071,095 | 1/1963 | Davis | 114/208 |
| 3,150,629 | 9/1964 | Fields | 114/206 |
| 3,841,255 | 10/1974 | Mansfield | 114/206 |
| 4,403,564 | 9/1983 | Garvin | 114/299 |

FOREIGN PATENT DOCUMENTS

| | | |
|---|---|---|
| 485605 | 10/1953 | Italy . |
| 62-242794 (A) | 10/1988 | Japan . |
| 77875 | 1/1951 | Norway . |

*Primary Examiner*—Edwin L. Swinehart
*Attorney, Agent, or Firm*—Whyte Hirschboeck Dudek

[57] ABSTRACT

A marine anchor having a cylindrical hub member including a plurality of radially extending, peripherally spaced, rod-like flukes. The anchor further includes a rod-like supporting handle extending substantially coextensive with and spaced radially from the hub member. The supporting handle is configured to define oppositely disposed bails arranged to alternatively receive a slidably mounted ring attachable to an anchor line or rope, depending upon the position of the anchor.

7 Claims, 2 Drawing Sheets

MARINE ANCHOR

BACKGROUND OF THE INVENTION

This invention relates to marine anchors. In particular, anchors made in accordance with this invention are of the type used in connection with recreational boats.

Conventional, manually operated anchors used for recreational boating associated with water sports, fishing, sailing or other activities, generally lack in several desirable characteristics. Specifically, conventional anchors usually have relatively short hinged flukes that lack desirable gripping action. Additionally, conventional anchors usually require relatively long anchor ropes. A long anchor rope may allow a boat to drift from a desired anchoring location, and further, such a rope may allow a boat to surge and sway with water movement. Furthermore, these anchors usually require that they be dragged along the bottom of a body of water until they engage an anchoring object which will secure a boat from drifting. This is objectionable to boaters who desire to anchor at a specific location, such as a fisherman who has used precise electronic fishing equipment to determine his desired location. Also, setting an anchor in this manner tends to agitate the bottom of the body of water, stirring up mud and silt which may further hinder a fisherman's efforts.

It is also difficult to lower conventional anchors quickly because these anchors often are characterized by large surface areas which are perpendicular to the direction of downward motion. Such surface areas will increase the effects of fluid resistance, slowing the descent of the anchor.

SUMMARY OF THE INVENTION

The anchor of the present invention will provide little fluid resistance as it is lowered to be set in place. Furthermore, the construction of the anchor is such that it can be set quickly by applying a force in one direction and can be removed just as quickly by applying a force in a direction opposite the direction of the setting force.

The commercial version of the anchor described and claimed herein comprises a body or hub, formed from a plastic coated, solid steel core. The hub has a plurality of peripherally spaced flukes projecting radially outwardly therefrom. The flukes are preferably in the form of steel rods of relatively small diameter with respect to the diameter of the body or hub. This configuration provides a virtually unobstructed, desirable weight mass, serving to permit the anchor to quickly drop to the lake or river bottom.

A steel support rod extends substantially coextensive and parallel with the axis of the anchor body or hub. The support rod is preferably spaced radially outwardly from the hub to slidably receive a ring supporting a short length of anchor chain. The opposite end of the chain is fastened to a conventional anchor line or rope. The support rod is further formed to define oppositely disposed bails for temporarily receiving the ring. Movement of the ring from bail to bail will depend upon whether the anchor is being set or retrieved. During setting, the ring will ride in a first bail to allow application of a force in a direction that will quickly engage the flukes. During retrieval, the ring will ride in a second bail to allow application of a force in a direction that will quickly disengage the flukes.

The anchor is of balanced design, permitting the aforementioned fast dropping action. The simplistic configuration further permits a relatively short yank or pull on the anchor rope in order to tip the anchor forward, thus permitting the flukes to immediately dig into the bottom. Thus, only a single, very short rope will be required. It will be realized that a short rope provides less opportunity for the boat to swing and sway from its desired anchoring position. The anchor is easily retrieved by rowing or motoring in a direction opposed to the seating position of the anchor.

The anchor is simplistic in design and inexpensively and facilely manufactured.

DESCRIPTION OF THE PREFERRED EMBODIMENT

Figure 1:
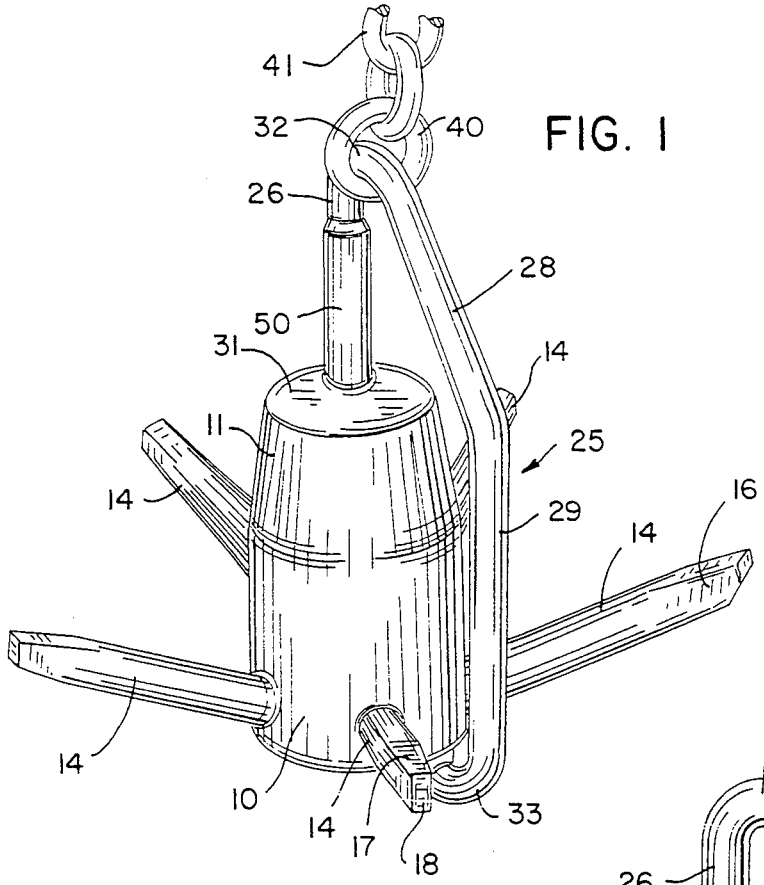
FIG. 1 is an oblique elevation of one embodiment of the present invention.
Figure 2:
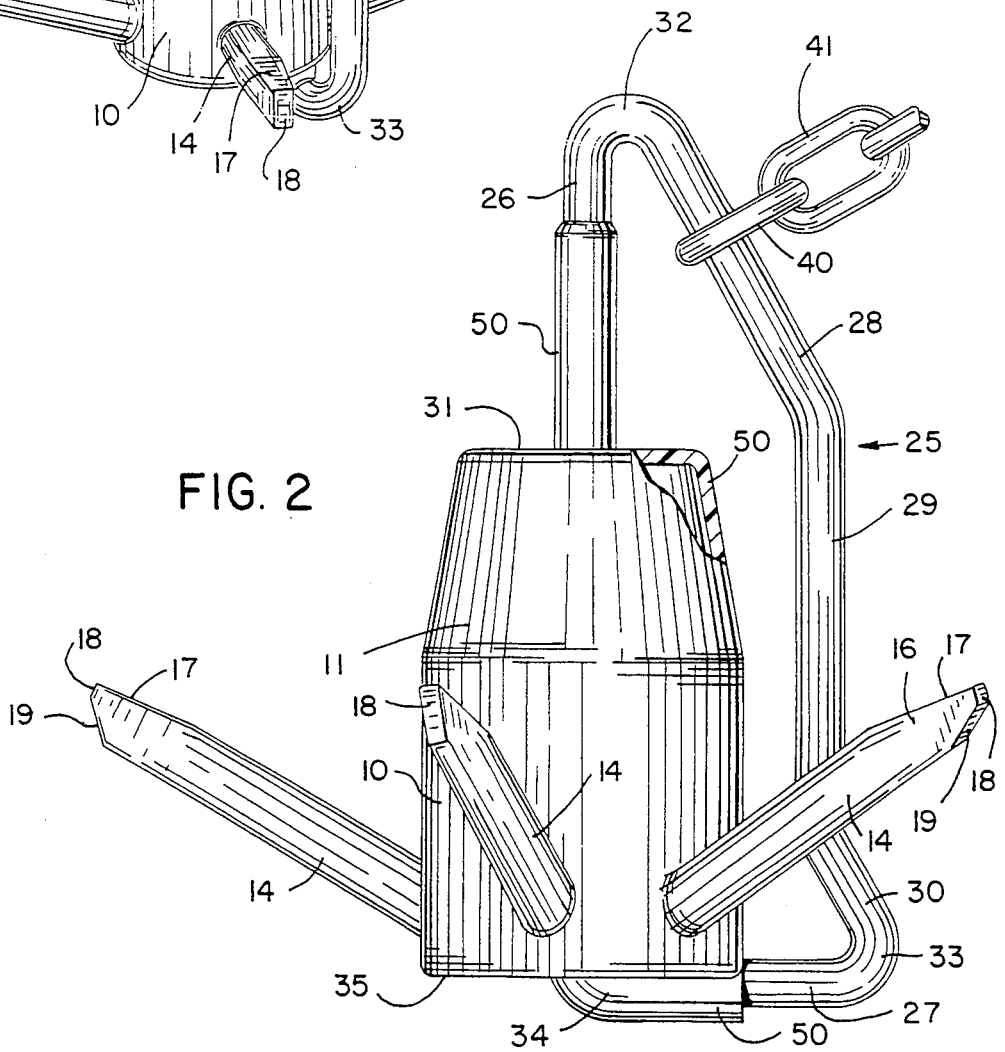
FIG. 2 is a side view of the anchor of FIG. 1.
Figure 3:
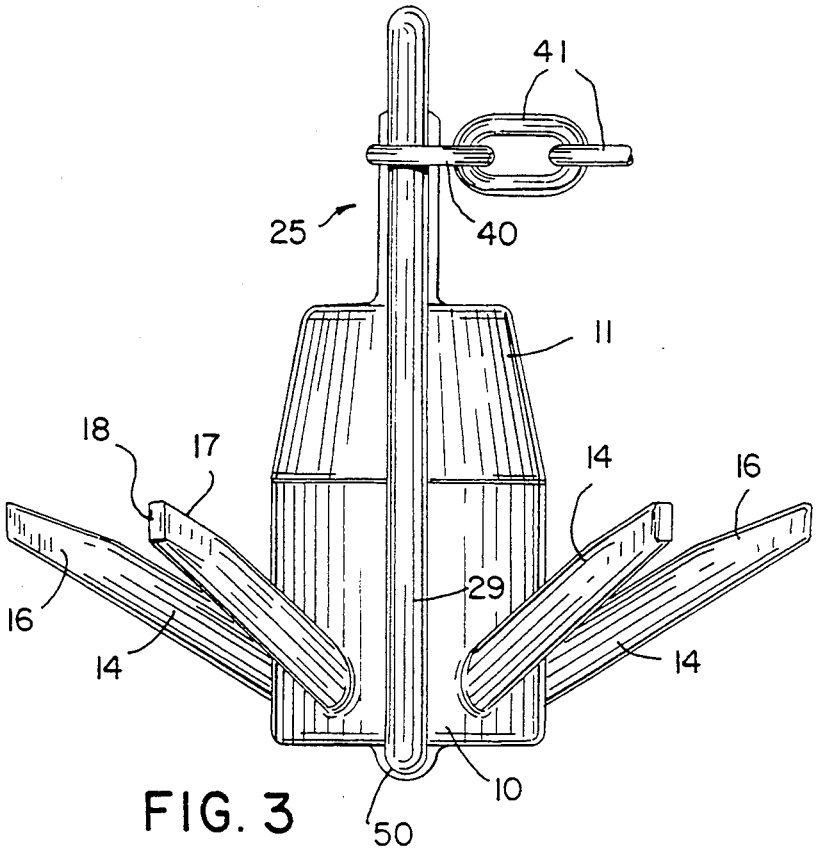
FIG. 3 is a front view of the anchor of FIG. 1.
Figure 4:
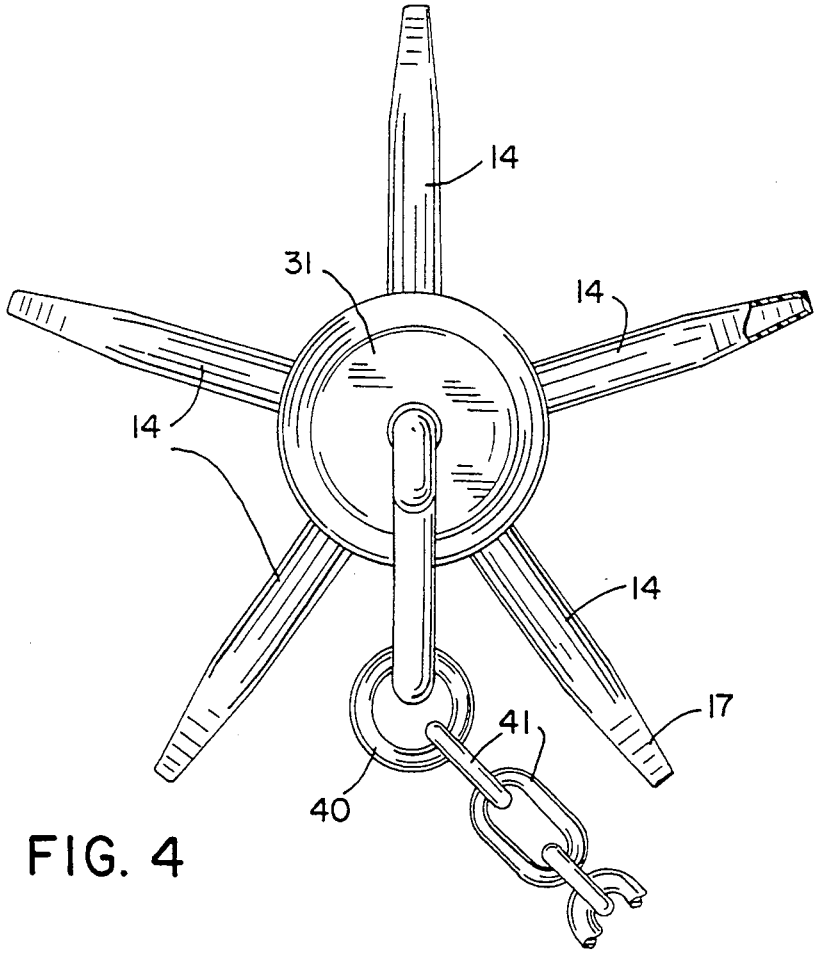
FIG. 4 is a top view of the anchor of FIG. 1.

A preferred embodiment of this invention is described with reference to the drawings. The invention provides an improved design for setting and disengaging a conventional recreational anchor. Like reference numerals are used to designate like parts or elements throughout the description and drawings.

The anchor consists of a body or hub, designated generally by the numeral 10. Hub 10 is preferably fabricated from a solid steel cylinder, which includes a tapered, truncated portion 11 at its uppermost end. Although not specifically shown, it will be understood by those skilled in the art that a steel shell may be substituted for the solid hub 10 configuration shown and further described herein. It will be apparent that such shell, when enclosed at both ends, may be filled with metallic shot or other material to approximate the desired weight of the preferred embodiment. Hub 10 is of circular cross-section. Such configuration provides the ultimate in simplicity and facile design, and ease in manufacture. It will be apparent, however, that a cylinder of polygonal cross-section may be substituted without departing from the spirit of the invention.

As shown, hub 10 is preferably provided with five (5) circumferentially or peripherally spaced, radially outwardly extending flukes 14. It is also within the province of this invention to provide fewer or greater number of flukes. Each fluke 14 is preferably fabricated from solid steel rod material. The inner end of each fluke is seated within previously drilled re-entrant openings located in hub 10. Each fluke 14 may be secured to hub 10 by welding or similar techniques, and preferably extends angularly upwardly therefrom at an angle of 60 degrees.

The outer or distal ends 16 of the respective flukes 14 are preferably tapered or otherwise narrowed or constricted. This fluke configuration provides additional means for penetrating or grasping anchoring bottom mud, rocks or other anchoring objects lying upon or formed at the desired anchoring location. As shown, end 16 of each fluke 14 is further defined by upper, relatively flat, angularly converging surface 17. Surface 17 terminates in relatively flat end surface 18. Flat end surface 18, in turn, intersects with relatively flat, angularly diverging surface 19. It will be understood that conically tapered distal end 16 of one or more flukes 14, may be provided without departing from this invention.

Anchor hub 10 is further provided with a supporting rod or handle, designated generally by the reference numeral 25. Handle 25 may be formed by conventional ½" steel rod, and includes integrally formed end sections 26 and 27, and intermediate sections 28, 29 and 30. End section 26 projects axially from upper end surface 31 of hub 10, and is seated and secured within a re-entrant opening drilled into upper end surface 31. Upper bail 32 is formed by bending rod or handle 25 downwardly, as shown in FIG. 1, such that sections 26 and 28 intersect to define upper bail 32.

Rod or handle 25 is further formed to define second intermediate section 29 which intersects with first intermediate section 28. Section 29 is preferably radially spaced from the axis of hub 10 and lies in a plane parallel therewith. Supporting handle 25 is further formed to provide outwardly angularly disposed intermediate section 30. Section 30, along with intersecting lower end section 27, define lower bail 33. Lower, inwardly bent, end section 27 includes distal end 34 that abuts lower end surface 35 of hub 10, and is secured thereto by welding or other fastening techniques.

Anchor ring 40 is provided to slidable encircle support rod or handle 25, and further engages an end link of an anchor chain 41. The opposite end of the chain (not shown) may be fastened to a single anchor rope for lowering and retrieving the anchor.

The anchor is easily retrieved by rowing or motoring the boat in a direction opposite from the original anchoring direction. Ring 40 is caused to slide to bottom bail 33 of supporting handle 25. A short pull will cause dislodgment of the flukes from the anchoring position.

It will be observed from the following description of the operation of the anchor of this invention that support handle 25 defines bails 32 and 33. Bails 32 and 33 are each arranged to temporarily receive slidably mounted ring 40, depending upon whether the anchor is being lowered into the water or is being retrieved from its anchored position.

It is also preferred to encase hub 10, each fluke 14, a portion of upper end section 26 and a portion of distal end 34 with a coating of a protective plastic material 50. The plastic material 50 is conventional, and readily available. The coating material 50 lessens the possibility of the anchor from rusting and also may be of an easily identifiable color, such as yellow.

It will be apparent that a relatively simple and unobstructed anchor configuration has been provided, as shown and described herein. The anchor configuration permits the anchor to sink rapidly when lowered into the water. A short pull or yank on the single anchor rope will urge anchor ring 40 to seat in upper bail 32, thereby causing the anchor to tip forward and permit a fluke or flukes 14 to immediately dig into the bottom mud or an anchoring obstruction. This diminished rope length will substantially lessen the possibility that a boat (not shown) will surge or sway.

One anchor configuration for small fishing boats weighs approximately 12 pounds, with an overall dimension of hub 10 being approximately 5" in length and approximately 3" in diameter. Each fluke 14 preferably extends about 3½" outwardly from hub 10. It will be apparent that the five peripherally spaced flukes 14, combined with the comparatively large mass/dimension of anchor hub 10, will substantially ensure that the anchor will be prevented from moving or rolling, and secure it in anchoring position.

Although a preferred embodiment of the anchor of this invention has been described and shown in considerable detail by reference to the drawings figures, this detail is provided for purposes of illustration only and is not to be construed as a limitation of the invention as described in the following claims.

What is claimed is:

1. A marine anchor comprising:

a. a hub member, b. a plurality of peripherially spaced fluke members extending radially outwardly from said hub member and proximate to one end of said hub member, c. a rod-like supporting handle member for said hub member and being of a length substantially coextensive of the length of the hub member, said supporting handle having a plurality of integrally formed sections and comprising;

(i) a first end section secured to one end of said hub member and extending substantially coaxially from a first end section of the hub member, (ii) a first intermediate section intersecting said first end section and extending angularly outwardly therefrom, (iii) a second intermediate section extending from said first intermediate section, radially spaced from said hub member and lying in a plane parallel with the axis of said hub member, (iv) a third intermediate section intersecting said second intermediate section and extending angularly outwardly therefrom, and (v) a second end section formed to bend inwardly relative to said third intermediate section and being secured proximate to the opposite end of said hub member;

d. said first end section and said intersecting first intermediate section of the supporting handle member defining a first integrally formed bail, and said third intermediate section and said intersecting second end section of said handle member defining a second integrally formed bail; and e. a ring member slidably received along the length of said handle member, whereby said ring is arranged to be alternately received in said first and second bails of said handle member, depending upon the position of the anchor during anchor lowering or retrieving activity.

2. A marine anchor according to claim 1, wherein the hub member is a cylinder of circular cross-section.

3. A marine anchor according to claim 2, wherein the hub member is tapered along a portion of its axial length.

4. A marine anchor according to claim 1, wherein the hub member includes five flukes.

5. A marine anchor according to claim 1, wherein the flukes extend at a 60 degree angle from the hub member.

6. A marine anchor according to claim 1, wherein the flukes are circular in cross-section and include, at the respective distal ends thereof, a first relatively flat surface angularly disposed relative to the axis of a respective fluke, and a relatively flat intersecting distal end surface lying in a plane substantially normal to the axis of the fluke, and a relatively flat undersurface intersecting the end surface and lying in a plane angularly relative to the axis of said fluke.

7. A marine anchor according to claim 1, wherein the exposed surface of the hub member, at least a portion of the end sections of the supporting handle member and each of the fluke members are coated with a protective plastic material.

* * * * *